United States Patent [19]

Nagasaka et al.

[11] Patent Number: 4,900,267

[45] Date of Patent: Feb. 13, 1990

[54] HARNESS CONNECTOR HAVING AN ENGAGEMENT CHECK STRUCTURE

[75] Inventors: Yasuhiro Nagasaka; Hiromichi Shigenobu; Kazuyuki Shiraki, all of Aichi; Akira Maeda, Shizuoka, all of Japan

[73] Assignee: Yazaki Corporation, Tokyo, Japan

[21] Appl. No.: 358,113

[22] Filed: May 30, 1989

[30] Foreign Application Priority Data

May 30, 1988 [JP] Japan ..... 63-70298[U]

[51] Int. Cl.[4] ..... H01R 13/71

[52] U.S. Cl. ..... 439/489

[58] Field of Search ..... 439/489

[56] References Cited

FOREIGN PATENT DOCUMENTS 61-169974 10/1986 Japan .

*Primary Examiner*—Gary F. Paumen

*Attorney, Agent, or Firm*—Armstrong, Nikaido, Marmelstein, Kubovcik & Murray

[57] ABSTRACT

An engagement check structure in a harness connector assembly. Detachable mating female and male housings are respectively accommodated with plural pairs of mating terminals and adapted to be locked to each other. In the structure, there is further provided at least one pair of mating terminals. One of the terminals of the pair is supported in the male housing while the other is generally secured within the female housing. The female housing is also formed with a tapered guide member which has a sloped surface therein. The terminal of the male housing has an ear portion formed at its forwardmost end to extend laterally. When the male housing is engaged halfway with the female housing, the ear portion rides over the tapered guide member to raise the terminal of the male housing. At the time of full engagement of both housings, the ear portion is released from the overriding engagement to bring the terminal of the male housing into elastic engagement with the terminal of the female housing.

4 Claims, 4 Drawing Sheets

HARNESS CONNECTOR HAVING AN ENGAGEMENT CHECK STRUCTURE

BACKGROUND OF THE INVENTION

The present invention relates to a harness connector having an incomplete engagement check structure for ensuring the connection of wire harnesses in an air bag system or the like for an automobile.

In an air bag system or the like, incomplete engagement of a harness connector for connection of wire harnesses and/or incomplete contact between male and female terminals in the harness connector will cause defective operation of the air bag system or the like, which will directly endanger a human life.

There is disclosed in Japanese Utility Model Laid-open Publication No. 61-169974 a harness connector having a function of detecting such incomplete locking. The conventional harness connector is shown in FIGS. 5A and 5B. Referring to the drawings, the harness connector is comprised of a male housing M having a lock arm 1 formed with a locking projection 1*a* and a female housing F having a stopper 2 adapted to engage the locking projection 1*a*. A plurality of chambers 5 and 6 are formed in the male and female housings M and F so as to receive a plurality of female terminals 3 and male terminals 4 adapted to mate thereto, respectively. Each of the female terminals 3 and each of the male terminals 4 are fixedly supported by supporting arms 7 and 8 formed in the chambers 5 and 6, respectively. Reference numerals $3_1$ and $3_2$ designate mating terminals serving as means for detecting the incomplete engagement. The terminals $3_1$ and $3_2$ are formed at their opposed ends with bent portions 9 and 9' adapted to contact with each other when both the housings M and F are completely engaged, that is, the locking projection 1*a* of the lock arm 1 of the male housing M is brought into engagement with the stopper 2 of the female housing F. Under the contact condition of the bent portions 9 and 9', electrical wires W and W' connected to the terminals $3_1$ and $3_2$, respectively, are electrically connected. When both the housings M and F are not completely engaged, the bent portions 9 and 9' are separate from each other to release the electrical connection of the electrical wires W and W', thus detecting the incomplete engagement of the harness connector.

In the above-mentioned construction, it is necessary to define a play C between the locking projection 1*a* and the stopper 2 for the purpose of disassembling the harness connector. As a result, there exists some looseness between both the housings M and F, causing separation or incomplete contact of the bent portions 9 and 9'. Such problems will also occur when either of the terminals $3_1$ or $3_2$ is inclinedly received in the housing M or F, or when either of the bent portion 9 or 9' is deformed. Thus, there is a possibility of the bent portions 9 and 9' as detecting means separating or incompletely contacting in spite of the locked condition of the harness connector, causing malfunction of the detecting means.

SUMMARY OF THE INVENTION

It is an object of the present invention to provide a harness connector having means for detecting incomplete engagement between male and female housings, which may maintain stable a contact condition between terminals for detecting such incomplete engagement to thereby ensure proper confirmation of whether or not both the housings are completely engaged under a locking condition.

According to the present invention, there is provided an engagement check structure in a harness connector assembly in which detachable mating first and second housings are respectively accommodated with plural pairs of mating terminals, said first and second housings being adapted to be locked with each other, said structure comprising at least one pair of a first terminal and a second terminal provided in addition to said plural pairs of mating terminals, said first terminal being accommodated within said first housing in generally secured fashion, said second terminal being accommodated within said second housing and rearwardly supported in cantilever fashion; and a tapered guide member secured to said first housing; said second terminal having an ear portion adapted to ride over said guide member to raise said second terminal when the first and second housings are incompletely engaged and to release said second terminal from said guide member and bring said second terminal into elastic contact with the first terminal when the first and second housings are completely engaged.

Other objects and features of the invention will be more fully understood from the following detailed description and appended claims when taken with the accompanying drawings.

DETAILED DESCRIPTION OF THE PREFERRED EMBODIMENT

Figure 5A:
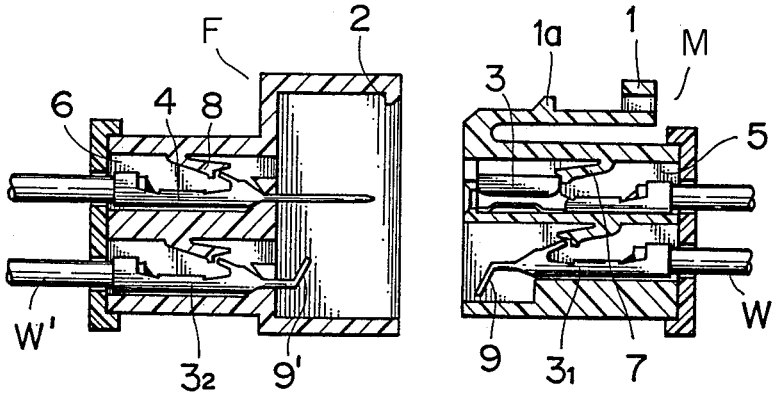
FIG. 5A PRIOR ART
FIGS. 5A and 5B are vertical sectional views of the conventional harness connector under the separate condition and the engaged condition, respectively.
Figure 5B:
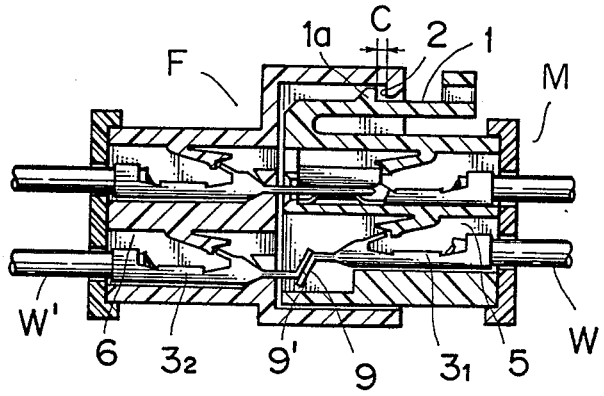
FIG. 5B PRIOR ART

There will now be described a preferred embodiment of the present invention with reference to the drawings in which the same reference numerals designate the same parts as those shown in FIGS. 5A and 5B.

Figure 1:
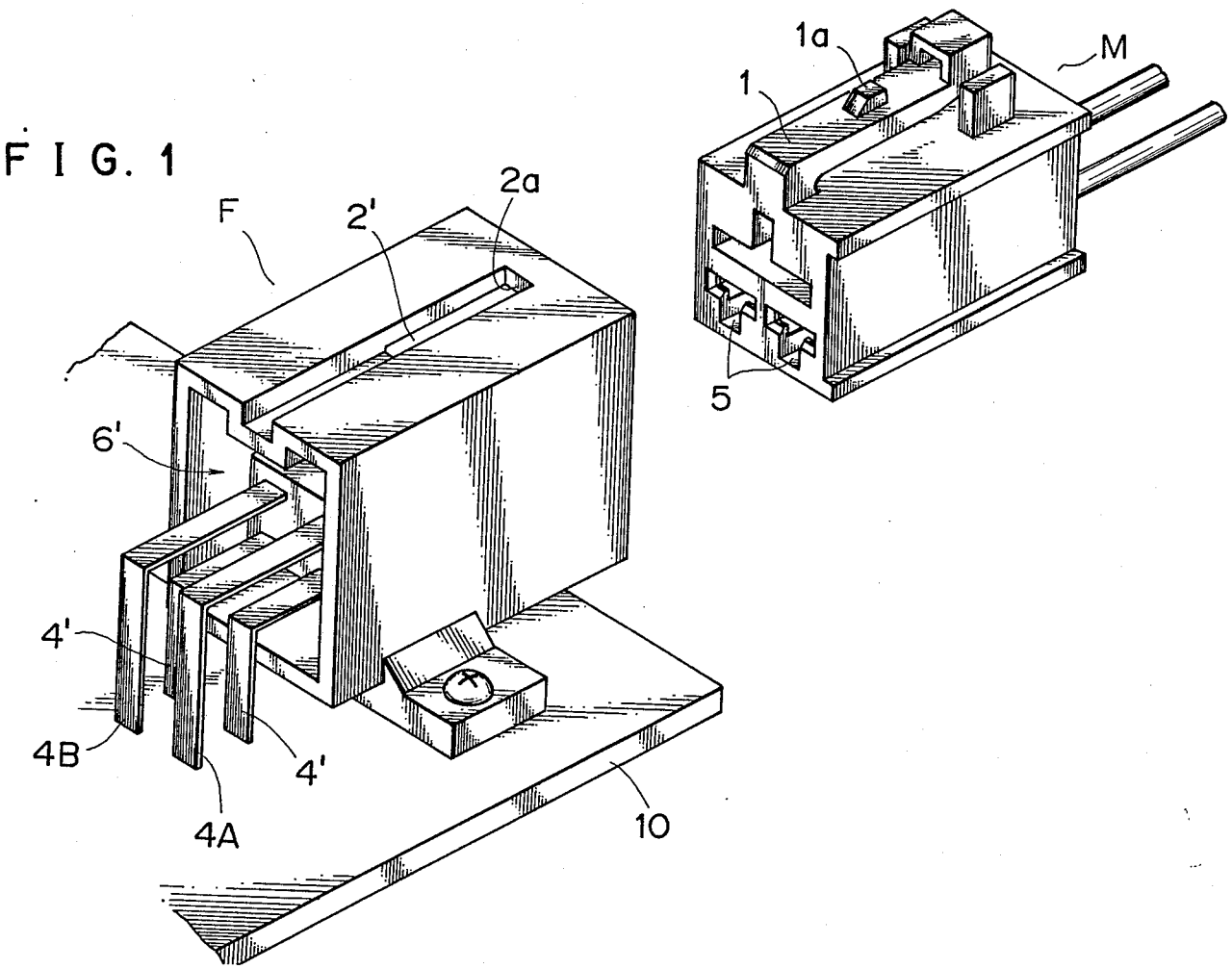
FIG. 1 is a perspective view of the harness connector under a separate condition according to the present invention.
Figure 2:
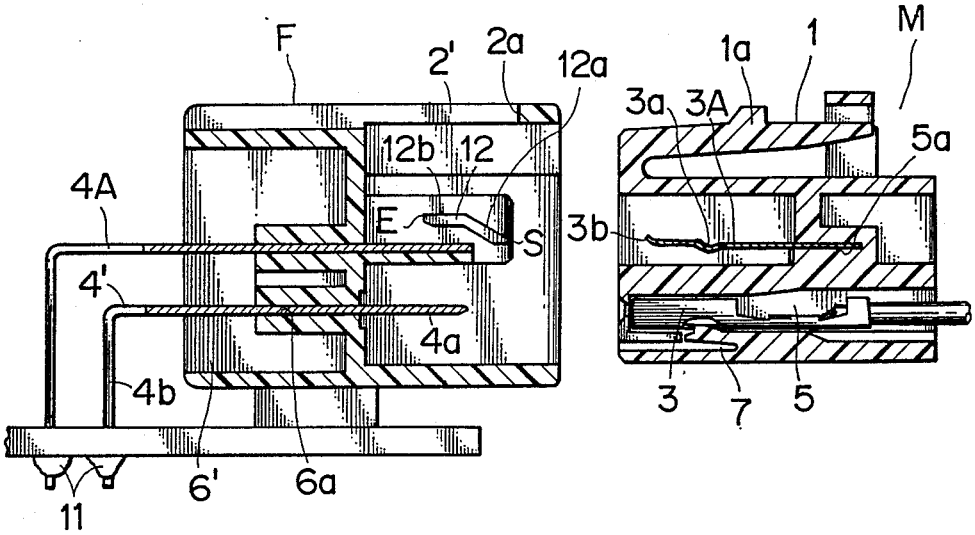
FIG. 2 is a vertical sectional view of FIG. 1.
Figure 3:
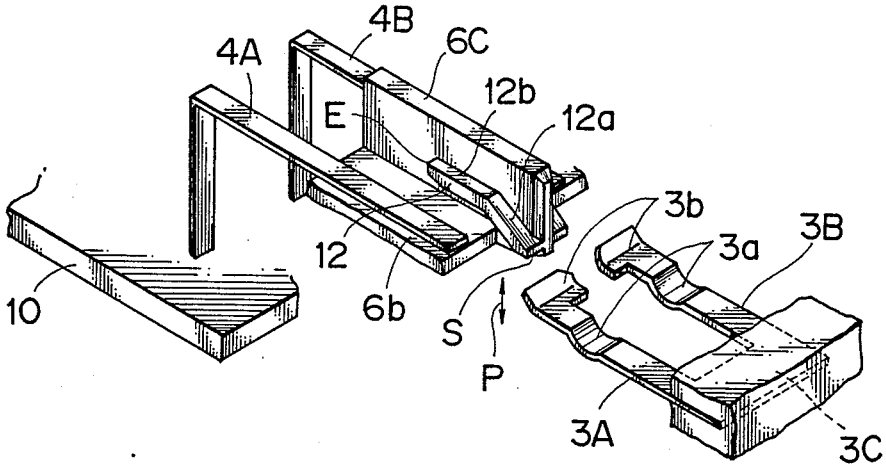
FIG. 3 is an enlarged perspective view of an essential part in FIG. 2.

Referring to FIGS. 1 to 3, a male housing M is integrally formed at its upper surface with a lock arm 1 extending in a longitudinal direction of the male housing M. The lock arm 1 is elastically pivotable at its left end as viewed in FIG. 2 like a lever. The lock arm 1 is integrally formed at its upper surface with a locking projection 1*a*. The male housing M has a pair of chambers 5 for receiving a pair of female terminals 3 to be fixedly supported by a pair of supporting arms 7, respectively.

On the other hand, a female housing F is formed at its upper surface with a channel 2' for engaging the locking projection 1*a* of the male housing M. The female housing F also has a pair of chambers 6' for receiving a pair of male terminals 4' to be connected to the female terminals 3 in the male housing M, respectively. As shown in FIG. 1, the female housing F is fixed to a printed circuit board 10, and as shown in FIG. 2, each of the male terminals 4' having an L-shape is fixed at its one end to the printed circuit board 10. More specifically, a horizontal portion 4a of each male terminal 4' is press-fitted with a hole 6a formed in an inner wall of the female housing F, and a vertical portion 4b of each male terminal 4' is soldered at 11 to a circuit (not shown) on the printed circuit board 10.

Reference numerals 3A and 3B designate elastically displaceable contactors disposed and rearwardly supported in cantilever fashion in the male housing M, and reference numerals 4A and 4B designate generally fixed contactors having substantially the same construction as the male terminals 4' and adapted to be connected to the elastically displaceable contactors 3A and 3B, respectively, thus forming means for detecting incomplete locking of engagement of the male and female housings M and F. In this embodiment, both displaceable contactors 3A and 3B and fixed contactors 4A and 4B are provided in the form of tab terminals.

The elastically displaceable contactors 3A and 3B are integrally connected at their bases through a connecting portion 3C, thus having a substantially U-shaped configuration. The connecting portion 3C is press-fitted with a hole 5a formed in an inner wall of the male housing M. Each of the contactors 3A and 3B is formed at its forward free end with an ear portion 3b having an L-shape such that the pair of said ear portions 3b project laterally inwardly toward each other. Each ear portion 3b is slightly bent upwardly at its free end to be opposed to the corresponding generally fixed contactors 4A and 4B. Each of the contactors 3A and 3B is further formed at its intermediate position with an arcuately curved portion 3a adapted to contact an upper surface of each of the corresponding fixed contactors 4A and 4B. The elastically displaceable contactors 3A and 3B are formed of an elastic conductor, and are displaceable in a direction of arrow P shown in FIG. 2.

The horizontal portions of the fixed contactors 4A and 4B are supported on horizontal inner walls 6b in the female housing F. A vertical inner wall 6c is formed between both the inner walls 6b, and a pair of tapered guide members 12 project from opposite side surfaces of the vertical inner wall 6c for guiding the ear portions 3b of the elastically displaceable contactors 3A and 3B. Each of the tapered guide members 12 has an inclined surface 12a extending from a lower end S to an intermediate position I and a horizontal surface 12b extending from the intermediate position I to an end E. As will be hereinafter described in detail, until the male housing M is brought into complete locking engagement with the female housing F, the ear portions 3b of the elastically displaceable contactors 3A and 3B are adapted to ride over and be engaged with the guide member 12. When the complete locking of the engagement between both the housings M and F is reached, the engagement between the ear portions 3b and the guide member 12 is released to bring the arcuately curved portions 3a of the elastically displaceable contactors 3A and 3B into elastic contact with the fixed contactors 4A and 4B. More specifically, the lower end S of the inclined surface 12a of each guide member 12 is located at a position such that each incomplete lock detecting portion 3b starts riding on the lower end S before the female terminals 3 start engaging the corresponding male terminals 4'. The end E of the horizontal surface 13b of each guide member 12 is located at a position such that when the lock projection 1a of the male housing M is brought into engagement with the channel 2' of the female housing F to reach the complete locking, each ear portion 3b comes out of engagement with the end E to bring the arcuately curved portions 3a into elastic contact with the fixed contactors 4A and 4B.

The horizontal surface 12b may be eliminated to extend the inclined surface 12a from the lower end S to the upper end E. Further, the connecting portion 3C of the elastically displaceable contactors 3A and 3B may be eliminated to independently form the contactors 3A and 3B like the prior art terminals $3_1$ and $3_2$ shown in FIGS. 5A and 5B and connect wires to the contactors 3A and 3B. The fixed contactors 4A and 4B may be replaced by the prior art male terminals 4 shown in FIGS. 5A and 5B.

Figure 4A:
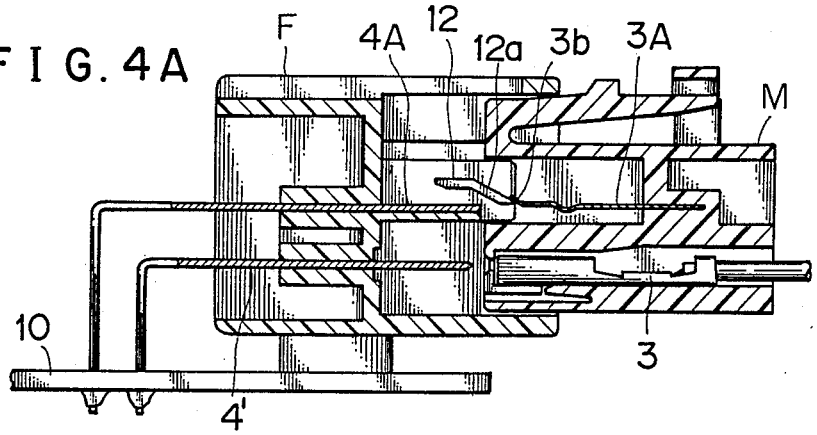
FIGS. 4A, 4B and 4C are vertical sectional views similar to FIG. 2, illustrating the operation of the preferred embodiment.

The operation of the above preferred embodiment will now be described with reference to FIGS. 4A to 4C.

Figure 4B:
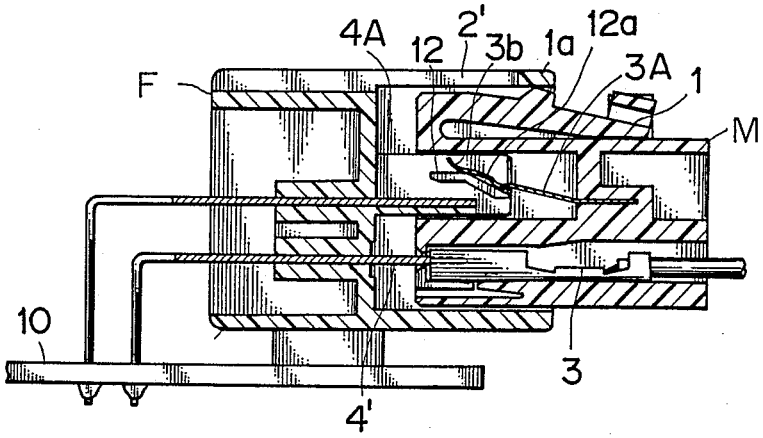
Figure 4C:
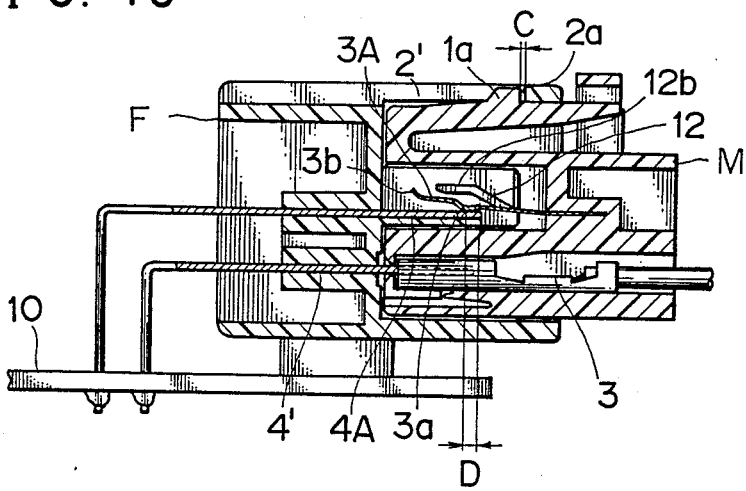

Referring first to FIG. 4C which shows an initial stage of engagement between the male housing M and the female housing F, when the male housing M starts engaging into the female housing F, the ear portions 3b of the elastically displaceable contactors 3A and 3B start overriding the inclined surfaces 12a of the guide members 12. At this time, the female terminals 3 have not yet been brought into contact with the male terminals 4'.

Referring next to FIG. 4B, as the engagement of the male housing M into the female housing F proceeds, the ear portions 3b are guided on the inclined surfaces 12a of the guide members 12 to bring the elastically displaceable contactors 3A and 3B into upward flexing. Thereafter, the ear portions 3b are guided on the horizontal surfaces 12b of the guide members 12 to reach the ends E thereof. At this time, the female terminals 3 are brought into electrical contact with the male terminals 4'. On the other hand, the lock arm 1 is downwardly flexed during insertion of the male housing M into the female housing F because of the provision of the locking projection 1a. Under the condition, the locking projection 1a has not yet been engaged with the channel 2' of the female housing F.

Referring next to FIG. 4C which shows a complete locking condition of both the housings, when the male housing M is fully engaged with the female housing F, the locking projection 1a is brought into engagement with the channel 2', and is prevented from being disengaged therefrom by a stopper wall 2a formed at an end of the channel 2'. At the same time, the ear portions 3b of the elastically displaceable contactors 3A and 3B are brought out of engagement with the horizontal surfaces 12b of the guide members 12 by the elastic force of the elastically displaceable contactors 3A and 3B. As a result, the arcuately curved portions 3a of the elastically displaceable contactors 3A and 3B come into elastic contact with the upper surfaces of the fixed contactors 4A and 4B.

Accordingly, the fixed contactors 4A and 4B are electrically connected to the elastically displaceable contactors 3A and 3B, respectively. As the contactors 3A and 3B are integrally connected with each other through the connecting portion 3C, the circuit on the printed circuit board 10 connected to the fixed contactors 4A and 4B is closed to turn on an alarm lamp or the like, thus confirming whether or not both the housings are completely engaged.

As shown in FIG. 4C, the arcuately curved portions 3a of the elastically displaceable contactors 3A and 3B are maintained in contact with the fixed contactors 4A and 4B in a sufficient lapping distance. Therefore, it is possible to prevent incomplete contact therebetween irrespective of a play C between the locking projection 1*a* and the stopper wall 2*a*. Accordingly, even when some looseness exists between both the housings M and F, or some deflection exists in a direction of engagement between the mating terminals, the contact condition between the elastically displaceable contactors and the fixed contactors may be maintained stable.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. An engagement check structure is a harness connector assembly in which detachable mating first and second housings are respectively accommodated with plural pairs of mating terminals, said first and second housings being adapted to be locked with each other, said structure comprising:

at least one pair of a first terminal and a second terminal provided in addition to said plural pairs of mating terminals, said first terminal being accommodated within said first housing in generally secured fashion, said second temrinal being accommodated within said second housing rearwardly supported in cantilever fashion; and a tapered guide member secured to said first housing, said second terminal having an ear portion adapted to ride over said guide member to raise said second terminal when the first and second housings are incompletely engaged and to release said second terminal from said guide member and bring said second terminal into elastic contact with the first terminal when the first and second housings are completely engaged, said first and second terminals engaging after the pairs of mating terminals engage.

2. An engagement check structure according to claim 1, wherein said first housing is a female housing while said second housing is a male housing.

3. An engagement check structure according to claim 1, wherein said ear portion projects laterally from a forward end of said second terminal.

4. An engagement check structure according to claim 1, wherein said first and second terminals are tab terminals.

* * * * *